United States Patent [19]

Angell

[11] 4,216,722

[45] Aug. 12, 1980

[54] EXPLODING BULLET

[76] Inventor: Howard N. Angell, N. 6809 Lincoln St., Spokane, Wash. 99208

[21] Appl. No.: 912,494

[22] Filed: Jun. 5, 1978

[51] Int. Cl.[3] ..... F42B 11/10

[52] U.S. Cl. ..... 102/91; 102/92.6; 102/38 PP

[58] Field of Search ..... 102/38 RP, 56 R, 91, 102/92.6

[56] References Cited

U.S. PATENT DOCUMENTS

| | | | |
|---|---|---|---|
| 36,686 | 10/1862 | Callender | 102/52 |
| 854,923 | 5/1907 | Broad | 102/91 |
| 2,359,301 | 10/1944 | Church | 102/56 R |
| 2,363,024 | 11/1944 | Thibodeau | 102/56 R |
| 2,472,118 | 6/1949 | Moore et al. | 102/56 R |

FOREIGN PATENT DOCUMENTS

| | | | |
|---|---|---|---|
| 11065 | of 1885 | United Kingdom | 102/56 R |

OTHER PUBLICATIONS

Ohart, Elements of Ammunition, Mar. 21, 1946, p. 28, John Wiley & Sons, Inc., New York.

*Primary Examiner*—Harold J. Tudor

[57] ABSTRACT

A small arms bullet containing an explosive charge that detonates on bullet impact to increase stopping-power. The bullet defines a medial cylindrical channel charrying explosive and a movable anvil. A cartridge primer in the forward part of the channel provides an impact detonation. My exploding bullet may be formed by modifying existing jacketed small arms bullets.

5 Claims, 8 Drawing Figures

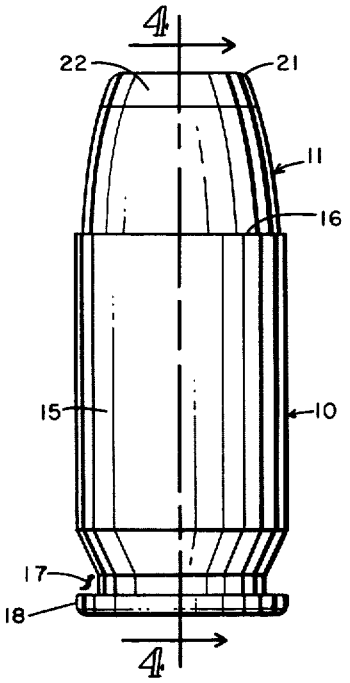
FIG. 1
FIG. 2
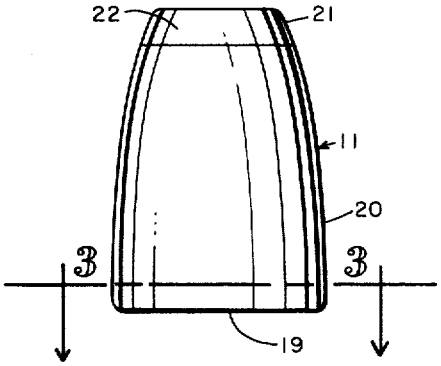
FIG. 3
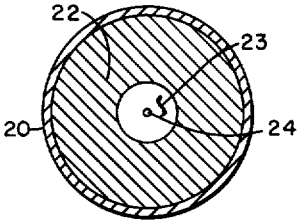
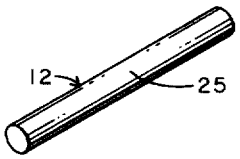
FIG. 6
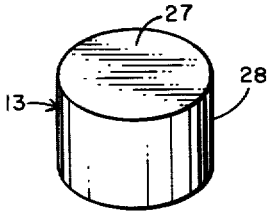
FIG. 8
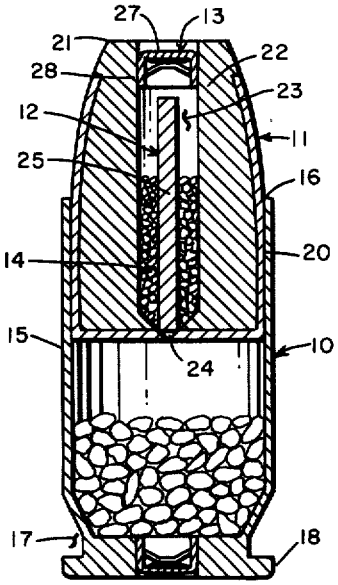
FIG. 4
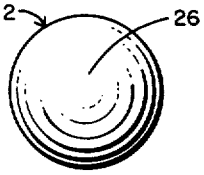
FIG. 7
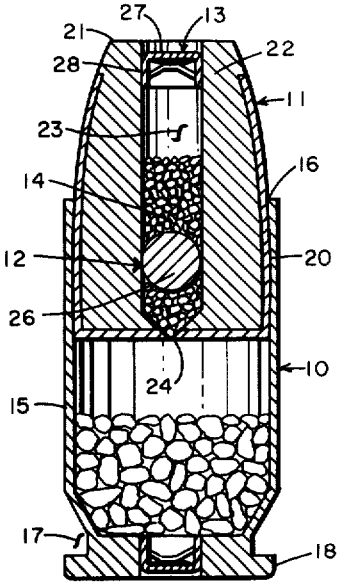
FIG. 5

EXPLODING BULLET

BACKGROUND OF INVENTION

RELATED APPLICATIONS

There are no applications related hereto now filed in this or any foreign country.

FIELD OF INVENTION

My invention relates generally to small arms ammunition and more particularly to an explosive bullet that increases shocking power.

DESCRIPTION OF PRIOR ART

The stopping-power of small arms bullets has been recognized as a problem substantially from the inception of small firearms; in modern small arms ammunition, especially with its increased bullet velocity, the stopping-power of the bullet has been of increasing concern and importance. This so called 'stopping-power' may be roughly defined as the ability of the bullet to kill or disable an animal within a relatively short period after impact, principally by shocking or maiming. Normally in practical applications a bullet's stopping-power should be such as to prevent evasive or defensive action by the impacted subject. The problem has been well considered and many solutions of it have been proposed.

For a small arms bullet to achieve maximum potential stopping-power the total bullet energy, or so much of it as possible, should be displaced within the impacted subject. With the high velocities of modern small arms bullets, the bullet must generally be modified in some fashion during its course through animal tissue to cause it to expend its full energy therein. This requirement has presented some practical problems in the bullet art as the bulk of animal tissue is generally quite soft but it also is of a non-homogeneous nature. Oftentimes quite sophisticated arrangements must be made to cause the bullet to maintain its trajectory and yet modify its form during passage through animal tissue. Most commonly this problem has been solved either by causing a mushrooming of the bullet so that it presents a surface of substantial area perpendicular to its course of travel or by causing fragmentation of the bullet so that its total energy is lessened in the fragmentation process and then distributed amongst many smaller fragments which have proportionately less inertia and move in many directions away from the original bullet course. Bullets embodying either or both of these principles have become known in many and various types but all generally have relied upon accomplishing their function by way of some physical construction or modification of the bullet, it's jacket or both and in general have not used explosives contained in the bullet to accomplish the purpose.

In the use of larger artillery projectiles it generally has been desired to do as much damage as possible upon projectile impact. A primary method of accomplishing this purpose has been to provide the projectile with some explosive charge that detonates upon impact to provide enhanced initial shock upon explosion and in many cases the secondary benefit of projectile fragmentation. Various larger artillery shells having explosive projectiles have heretofore become known. These projectiles in general, however, have had either some complex construction and explosive arrangement or a complex fusing mechanism, either or both of which have not made them applicable to use in small arms ammunition. The economics also have not favored the use of this type of explosive structure in small arms bullets as a proportionately greater amount of money may be expended in the production of artillery projectiles than may be expended for small arms bullets.

With this background in mind my invention seeks to combine the advantages of using an explosive charge to provide additional shock and to fragment or mushroom small arms bullets to provide a substantially greater stopping-power than the same bullet with the same velocity would have without the features and generally a greater stopping-power than would be had by any of the non-exploding mushrooming and fragmenting bullets of present day commerce. In so doing I use existing jacketed small arms bullets of present day commerce and modify them to embody my invention therein. I provide a simple impact detonating system for my explosive charge that is created from existing munition elements but yet provides for appropriate handling safety, positive detonation upon impact and no predetonation in a gun barrel. The explosive force of my bullet may be used with appropriately designed bullets to either enhance mushrooming, fragmentation or both as desired depending upon bullet construction. My invention may be embodied in a bullet at a cost not substantially greater than that of the present day jacketed bullet of similar type and yet is extremely reliable and relatively safe.

SUMMARY OF INVENTION

My invention in general provides a jacketed bullet defining a medial chamber carrying an explosive charge and preferably an anvil that contacts an associated detonator to initiate an explosion upon impact of the bullet with a target.

I modify an ordinary metal jacketed lead alloy bullet of commerce to embody my invention by boring an axially aligned cylindrical hole from the apex through the core and into the base of the bullet jacket. I preferably place in this chamber a metallic anvil of either spherical or rod shape that is relatively free to move in a direction parallel to the bullet axis. A charge of explosive, commonly of the black powder type, is placed in the chamber and the front end is closed with an ordinary cup type small arms primer of present day commerce. The primer is seated with its open portion facing the explosive charge and its base slightly below the level of the tip of the bullet so that the primer may not be accidentally detonated during handling or loading operations. The primer is positionally maintained by adhesion to the bullet core walls defining the explosive chamber. The completed bullet is loaded into an appropriate cartridge case in the normal fashion and fired as any other bullet. Upon impact the detonator will ignite the explosive charge to cause an explosion which will either accentuate the bullet mushrooming or fragmentation and create additional schocking-power to fulfill the objectives of my invention.

In creating such a bullet it is:

A principal object to provide a small arms bullet with an explosive charge that detonates upon impact to enhance bullet stopping-power.

A further object to create such an explosive bullet that may be formed by modifying existing small arms bullets of commerce.

A further object to provide such a bullet that may use the force of its explosion to enhance the mushrooming, fragmentation or both depending upon bullet design.

A still further object to provide such an explosive bullet that is most sure of detonation upon impact but yet is relatively safe during handling and loading processes and may be otherwise used as ordinary bullets of similar nature.

A still further object of my invention to provide such an explosive bullet that may be formed by relatively simple operations and by the use of standard ordinance parts of commerce to provide a product of relatively low cost.

A still further object of my invention to provide such an explosive bullet that is of new and novel design, of rugged and durable nature and simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 1 is a surface view of an ordinary pistol cartridge (0.45 ACP) embodying a bullet of my invention.

FIG. 2 is an isometric view of the bullet of the cartridge of FIG. 1 showing its various parts, their configuration and relationship.

FIG. 3 is a horizontal cross-sectional or plan view of the bullet of FIG. 2 taken on the line 3—3 thereon in the direction indicated by the arrows.

FIG. 4 is a vertical, medial cross-sectional view of the cartridge of FIG. 1 taken on the line 4–4 thereon in the direction indicated by the arrows.

FIG. 5 is a cross-sectional view similar to that of FIG. 4 but showing a species of my invention using a spherical type anvil rather than the rod type anvil shown in the principal form of FIG. 4.

FIG. 6 is an isometric view of the rod type detonator anvil of my invention.

FIG. 7 is an isometric view of the spherical type detonator anvil of my invention.

FIG. 8 is an isometric view of a typical cartridge primer used as a detonator in my invention.

DESCRIPTION OF THE PREFERRED EMBODIMENT

My invention provides generally jacketed bullet 11 defining a medial axially aligned explosive chamber carrying explosive 14 and detonator anvil 12 with cup type primer 13 sealing the forward end of the chamber.

A typical hand gun cartridge 10, in this case a 0.45 caliber ACP, is shown in the illustration of FIG. 1, where it is seen to provide cylindrical cartridge case 15 terminating in forward bullet holding mouth 16 and defining in its rearward part ejector groove 17 and rim 18. Bullet 11 is seated in mouth 16 and normally positionally maintained by frictional engagement though in some instances it may be sealed or adhered therein. Though designs vary widely, all small arms ammunition insofar as my invention is concerned have essentially the same parts, although commonly in rifle shells mouth 16 will be necked down to a smaller diameter than case 15 and oftentimes in some shells there will be no ejection groove 17 in which case rim 18 is of larger diameter than case 15. The explosive bullet of my invention, however, may generally be used with all such small arms cartridges.

My bullet 11 is seen bestly in FIG. 2 and in detail in FIGS. 3, 4 and 5. It provides a harder, relatively thin metal jacket defining base 19, cylindrical side walls 20 and open ended tip 21 all enclosing similarly shaped softer core 22. Commonly, though not necessarily, the tip of the bullet will be formed by the projection of the forward part of the case forwardly beyond the forward part of the jacket. The bullet apex may be pointed or truncated as desired. Commonly the core will be formed of some lead alloy of relatively high density to provide a bullet of appropriate cross-sectional coefficient and the jacket will be formed of some harder material that will not adhere to a gun barrel. This type of bullet, though it comes in many sizes, shapes and configurations, in its essence at least, is common in the small arms ammunition arts of the present day and it is this type of bullet in which my invention is defined.

Starting with a solid core bullet of this type, I modify it as illustrated particularly in the cross-sectional view of FIGS. 3 and 4 by creating explosive chamber 23 therein. The forward portion of this chamber is of a size appropriate to seat primer 13 as hereinafter provided and the shape should be circularly symmetrical to provide bullet stability, but otherwise the shape and size of the chamber may vary widely within the ambit of my invention. In the form illustrated, the particular explosive chamber is of uniform circularly cylindrical shape formed by drilling. Normally this configuration of chamber is adequate for the purposes of my invention. The particular shape of the chamber will determine largely whether the bullet mushrooms or fragments and its size to some degree will regulate the degree of such mushrooming or fragmentation.

It has been found most desirable to define some indentation or small hole in the inner surface of the medial portion of base 19 of the bullet jacket to create the utmost stopping-power for the bullet. If explosive chamber 23 be formed by drilling, this indentation 24 may be conveniently formed by the point of the drill that forms the chamber. The exact nature or size of the indentation has not been found to be too critical but mushrooming and fragmentation effects both seem to be enhanced if the medial portion of the base be weakened to some degree. Obviously this indentation should be such as to prevent passage of explosive in the explosive chamber therethrough and prevent ignition of such explosive during the firing of the bullet.

A detonator anvil preferably is carried in explosive chamber 23 to aid the detonation of the primer 13. The purpose of this anvil is to provide impact on the inner side of primer 13 and the anvil may therefore take several shapes and yet accomplish its purpose. The particular anvil 25 shown in the illustration of FIG. 4 takes the shape of a cylindrical rod having both a diameter and length somewhat less than that of explosive chamber 23. The form of anvil 26 shown in the cross-sectional view of FIG. 5 and in FIG. 7 takes the form of a sphere of a diameter slightly less than that of the explosive chamber. Either form of anvil seems to function well though obviously the details of the functioning must be somewhat different in the two cases. The anvil is not an absolute necessity in my invention as the detonator will generally institute explosion upon impact without the anvil, but it was found that when no anvil was used there would be some misfires ranging in about the five percent range. With the use of either of the anvils illustrated there are substantially no misfires upon bullet impact even in extremely soft matter such as congealed gelatin or fruit.

Explosive 14 is some type of explosive material that may be detonated by primer 13. I prefer to use ordinary fine grained black power of commerce though the modern day black powder substitutes such as Pyrodex of the Hodgen Powder Company and many of the trinitrotolune, nitrocellulose and nitroglycerine based smokeless powders of present day commerce will serve the purposes of my invention though the nature and effect of their explosion may be somewhat different. The only particular requirements of this explosive are that it be detonated by primer 13 upon the explosion of that primer and that the explosive material not be detonated by the impact, inertia, heat or other conditions of bullet firing at any time before impact. Most commercial gun powders of present day commerce that have been tried have been found to function in my invention whether of the black powder or smokeless variety. Depending upon particular powder characteristics, energies and results desired, some are more efficient than others.

Primer 13 is an ordinary cartridge primer of present day commerce. It is of the cup-like shape illustrated particularly in FIG. 8 with flat circular base 27 communicating with perpendicularly related circularly cylindrical side walls 28. The forward portion of explosive chamber 23 should be so sized as to accept this cylindrical primer in a nice fit so that it may be maintained in the forward portion of that chamber as illustrated especially in FIGS. 4 and 5. Preferably the primer is seated slightly below the forwardmost part of the bullet nose so that the primer surface will not be accidentally contacted during handling or loading by any object that might cause its premature detonation. Normally a recess of approximately one-thirtysecond of an inch is sufficient. The primer is held in place, maintained and sealed by one of the metal to metal adhesives of present day commerce such as the cryoacryllic glues. It is not necessary that this primer be adhered to the walls defining the explosive chamber but it has been found that friction alone will not well positionally maintain it and if there be no seal in the forward portion of the explosive chamber water or some other deleterious substance might enter the explosive chamber to damage or modify the explosive.

The common primers of commerce are provided in two sizes for each of rifle and pistol cartridges. I prefer to use the larger pistol primer in my invention as it has been found to be most effective. Generally the pistol primers have a thinner material forming the primer cup and therefore are more sensitive to impact. This is an advantage to my invention as if the bullet pass into a very soft substance its impact therewith may not be too great. The rifle type primers have a thicker case and require a greater impact to cause their detonation. I have found that the rifle primers are not particularly efficient in use with my invention and may cause misfires. The small pistol primer is substantially of the same structure as the large pistol primer but has a somewhat less detonating explosition and for this reason generally is less desirable.

A sealant such as red sealing wax may be used to seal the explosive chamber forwardly of the seated primer cup but this has been found not to be particularly desirable because the solid contact of the sealant with the primer may transmit impact to cause accidental detonation of the primer during handling or loading operations. The slight hollow specified has been found not to cause any particular problems and it is preferable to leave it unfilled.

Having thus described my invention, its operation is fairly obvious.

An explosive bullet is created according to the foregoing specification and thereafter seated in the appropriate cartridge case 15 according to the practice in the present day arts to form a completed cartridge 10. The cartridge is then loaded and fired through any appropriate gun in the ordinary fashion. Upon impact of the fired bullet with some object, primer 13 will be detonated and it in turn will detonate explosive 14 to cause a explosion in explosive chamber 23. This explosion will tend to accelerate either the mushrooming or fragmentation of bullet 11, depending upon its particular design and configuration. In the bullet illustrated, the design is conceived for mushrooming and that mushrooming will be greater than would be accomplished with the same bullet under the same conditions without my invention. The explosion of the bullet will also create additional shock per se above that derived from the bullets kinetic energy.

The exact functioning of the detonator anvil is not clearly understood, but as indicated some misfires were commonly experienced in explosive bullets that did not have the anvil. Apparently the rod type anvil illustrated in FIG. 4 moves forwardly by reason of inertia, upon impact of the bullet with some object, so that the anvil comes into contact with the backside of primer 13 to aid its detonation. Most probably, however, the spherical anvil illustrated in FIG. 5 cannot come into direct contact with the primer because commonly there will be some explosive therebetween. Apparently in the case of the spherical anvil it either compresses or impacts the powder against the inner surface of primer 13 to aid its detonation. Either form of anvil, however, seems to be about as effective as the other.

My invention is operative without indentation 24 in the medial portion of the base of the bullet jacket, though it has been found that both mushrooming and fragmentation are somewhat enhanced by a weakening of the medial portion of that jacket base. Again it is not entirely clear what function this weakening serves, but it is thought that it provides an initial rupture of fracture point which either aids the rupture or fracturing of the case or causes it to proceed in a more uniform fashion.

It should be noted that although my invention has been described as embodied in a pistol bullet, it is equally well adapted for use in rifle bullets and is applied in identically the same fashion. Because of the generally higher velocity of rifle bullets a rifle primer may be used as primer 13 in my invention since the bullet's impact is so great that it will explode as well as a pistol type primer. In applying my invention to rifle bullets care should be exercised in seating primer 13 below the forward lip of explosive chamber 23 as commonly rifles have steeply angled ramps over which the bullet enters the barrel chamber and this situation could possibly cause the detonator to be detonated upon entry of the bullet into the chamber.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. An explosive bullet for small arms ammunition comprising, in combination:

a bullet having a core encased in a thinner jacket defining circularly cylindrical sidewalls to engage the bore of a gun barrel, a relatively flat base and a tip; and defining an explosive chamber extending from the tip through the core and into the relatively flat base of the jacket, the explosive chamber having a circularly cylindrical configuration and a forwardmost portion configured to receive and be covered by a detonator;

an explosive carried in the explosive chamber; and a detonator carried in the forwardmost part of the explosive chamber.

2. The invention of claim 1 further characterized by:

an elongate rod-like anvil having a length and diameter less than the respective similar dimensions of the explosive chamber carried in the explosive chamber.

3. The invention of claim 1 further characterized by:

an anvil carried in the explosive chamber comprising a spheroidal ball of a diameter less than that of the explosive chamber so that it might move therein.

4. The invention of claim 1 further characterized by:

the detonator primer being seated slightly below the forwardmost portion of the tip of the bullet and adhesively fastened to the walls defining the explosive chamber.

5. The invention of claim 1 further characterized by the explosive comprising granular black powder.

* * * * *